United States Patent [19]

Juranitch

[11] Patent Number: 4,852,305

[45] Date of Patent: Aug. 1, 1989

[54] FISHHOOK SHARPENER

[76] Inventor: John C. Juranitch, Rte. 1, Box 2006, Ely, Minn. 55731

[21] Appl. No.: 222,362

[22] Filed: Jul. 20, 1988

Related U.S. Application Data

[63] Continuation of Ser. No. 946,930, Dec. 17, 1986, abandoned.

[51] Int. Cl.[4] ..... B24B 7/00

[52] U.S. Cl. ..... 51/59 R; 51/211 R

[58] Field of Search ..... 51/59 R, 211 R

[56] References Cited

U.S. PATENT DOCUMENTS

| | | | |
|---|---|---|---|
| 2,452,697 | 11/1958 | Stabler | 51/59 R |
| 2,520,523 | 8/1950 | Bloomquist | 29/76 R X |
| 2,657,503 | 11/1953 | Gaines | 51/59 R |
| 2,845,692 | 8/1958 | Moussette | 51/59 R X |
| 4,538,382 | 9/1985 | Johannsen | 51/211 R X |

*Primary Examiner*—Nicholas P. Godici
*Assistant Examiner*—Carmine Cuda
*Attorney, Agent, or Firm*—Dority & Manning

[57] ABSTRACT

An apparatus for sharpening fishhooks including an element for grinding a first flat surface on the end portion thereof which lies in a plane which is generally transverse to a plane through the longitudinal axis of both the shank and the end portion of the fishhook, which also intersects the longitudinal axis of the end portion. This flat surface is disposed on the side of the end portion closest to the shank of the hook. The apparatus also provides for grinding a second flat surface on the end portion which intersects the plane of the first flat surface and the longitudinal axis of the end portion, and also for grinding at least a third flat surface on the end portion which lies in a third plane which intersects the plane of one of the flat surfaces and the longitudinal axis of the end portion. The apparatus is adapted to grind more than three flat surfaces but the side of the end portion which is closest to the shank of the fishhook must always have a flat surface which lies in a plane which is generally transverse to the plane drawn through the longitudinal axis of the shank and the end portion.

12 Claims, 5 Drawing Sheets

FISHHOOK SHARPENER

This is a continuation of application Ser. No. 06/946,930, filed Dec. 17, 1986, which was abandoned upon the filing hereof.

BACKGROUND OF THE INVENTION

Heretofore, fishhooks have been manufactured by automatic machines which take a specially prepared wire and shape it to form the point and barbed portions as well as the curved and shank portions in one stamping operation. After the fishhooks are formed, they are subsequently subjected to special hardening processes such as chrome plating and the like to form a durable fishhook.

However, it has been found that the shape of the commercially made fishhook is nt the most desirable shape for assuring that a fish coming into contact with the point of the hook is impaled by the fishhook.

SUMMARY OF THE INVENTION

The invention comprises a new and improved fishhook which has a shank portion, a barbed portion, a curved portion connecting the shank and the barbed portions, and an end portion in which the point of the fishhook is formed by a first flat surface which lies in a plane which is generally transverse to a plane taken through the longitudinal axes of both the shank portion and the end portion of the fishhook. The plane of the flat surface also intersects the longitudinal axis of the end portion and the flat surface is disposed on the side of the end portion closest to the shank portion. The end portion of the fishhook has a second flat surface which lies in a plane which intersects the plane of the first flat surface and the longitudinal axis of the end portion. At least one other flat surface is provided at the end portion which lies in a third plane which intersects the plane of the first flat surface and the longitudinal axis of the end portion. Where only three flat surfaces are utilized, the plane of the third flat surface will also intersect the plane of the second flat surface. At the points of intersection between the planes of the flat surfaces, a cutting edge is provided, with the cutting edges running at angles to the longitudinal axis of the end portion of the fishhook thereby terminating into a very sharp point on the fishhook. The first flat surface will always lie in a plane which is generally transverse to a plane taken through the longitudinal axis of the shank and the end portion so that this surface will form a shovel-type surface which will tend to cam or force the point of the hook into the flesh of a fish coming into contact with it when tension is exerted on the shank by a fishing line or the like.

More than three flat surfaces may be used, as desired, however, the flat surface on the side of the end portion closest to the shank of the fishhook must lie in a plane which is generally transverse of a plane drawn through the axis of the shank and the axis of the end portion and each of the flat surfaces must lie in planes which intersect the plane of two adjacent flat surfaces and the axis of the end portion. A cutting edge will be formed at each point of intersection of the planes so as to produce an extremely sharp fishhook.

The invention also includes a method for producing the flat surfaces on the end portion and three embodiments of apparatus for carrying out the method and producing the flat surfaces on the end portion of the fishhooks.

Accordingly, it is an important object of the present invention to provide a fishhook having a very sharp point.

Another important object of the present invention is to provide a fishhook that will have a flattened shovel-type surface on the side of the end portion closest to the shank of the fishhook.

Still another important object of the present invention is to provide a simple and efficient method for producing an improved fishhook with a new and sharper point.

Yet another object of the invention is to provide simple apparatus which can be used for sharpening the points on fishhooks to produce three or more flattened surfaces which terminate in a point at the end of the fishhook.

These and other objects and advantages of the invention will become apparent upon reference to the following specification, attendant claims, and drawings.

Figure 12:
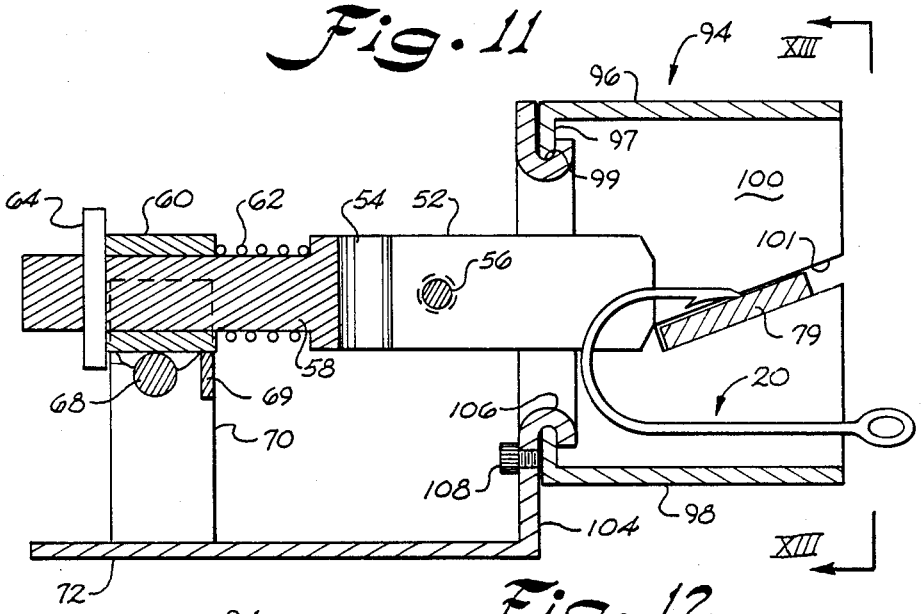
FIG. 12 is a side view, partially in section, of a third embodiment of the apparatus of the invention.

13—13 of FIG. 12.

DETAILED DESCRIPTION OF THE INVENTION

Figure 1:
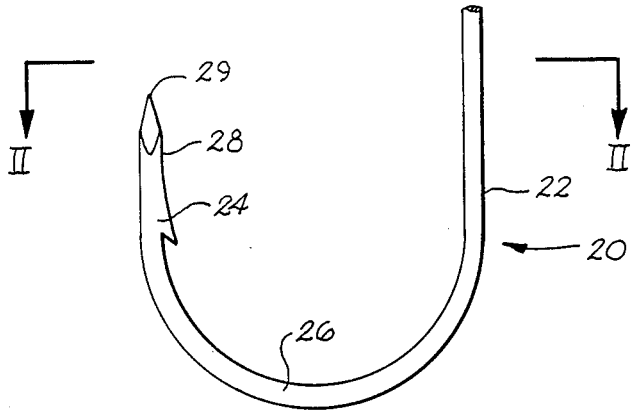
FIG. 1 is a partial side view of a fishhook having an end portion shaped in accordance with the present invention.
Figure 2:
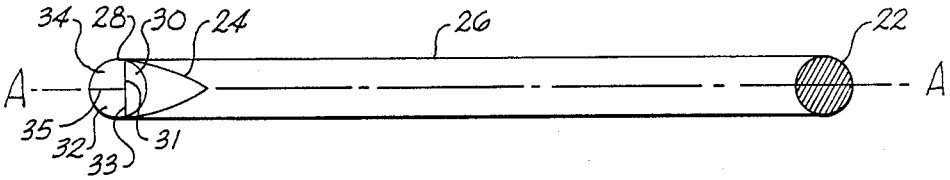
FIG. 2 is a top plan view, partially in section, taken along line 2—2 of FIG. 1.

Referring now in more detail to FIGS. 1 and 2 of the drawings, a fishhook 20 is shown having a shank portion 22, a barbed portion 24, and a curved portion 26 which connects the shank and the barbed portions of the hook. Just above the barbed portion of the hook is an end portion 28 which terminates in a point 29. Point 29 is formed on the end portion of the fishhook by shaping a first flat surface 30. Flat surface 30 lies in a plane which is generally transverse to plane A—A, which extends through the longitudinal axis of the shank and the end portions of the fishhook. The plane in which flat surface 30 lies also intersects the longitudinal axis of the end portion of the fishhook so as to form a shovel surface facing the shank.

A second flat surface 32 lies in a plane which also intersects the longitudinal axis of the end portion and the plane of flat surface 30. At the point where the plane for flat surface 32 intersects the plane for flat surface 30, is formed a cutting edge 33 which extends from point 29 to the periphery of the end portion.

A third flat surface 34 lies in a third plane which intersects the longitudinal axis of the end portion and the planes of the first and second flat surfaces, 30 and 32. At the point where the plane of surface 34 intersects the planes of surfaces 30 and 32 are formed two additional cutting edges which extend from the point 29 of the fishhook to the periphery of the end portion.

A fishhook having an end portion shaped as shown in FIGS. 1 and 2 is extremely sharp and shovel surface 30 has a tendency to cause the end of the hook to penetrate deeply into the flesh of the fish whenever tension is applied to the fishhook as a whole through shank 22 by a fishing line or the like.

Figure 3:
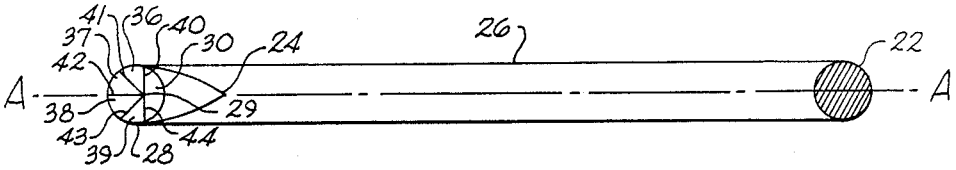
FIG. 3 is a view similar to FIG. 2 showing an alternative form of the point of the present invention.

FIG. 3 illustrates another embodiment of the fishhook of the invention similar to that shown in FIGS. 1 and 2 but having five flat surfaces on the end portion. In this embodiment, similar elements to those of FIGS. 1 and 2, are identified by like reference characters. For example, surface 30 remains the same as surface 30 in FIG. 2. A second flat surface 36 is formed in a plane which intersects the longitudinal axis of the end portion and the plane in which surface 30 lies. A third flat surface 37 lies in a different plane which intersects the longitudinal axis of the end portion as well as the plane of the second flat surface 36. A fourth flat surface 38 lies in yet another plane which intersects the longitudinal axis of the end portion and the plane in which the third flat surface 37 lies. A fifth flat surface 39 lies in still another plane which intersects the longitudinal axis of the end portion and the planes of flat surface 38 and flat surface 30. Thus it is seen, that the planes of each of the flat surfaces 30, 36, 37, 38 and 39 intersects the planes of two adjacent flat surfaces. At the point of intersection between the planes of the flat surfaces are formed a first cutting edge 40, a second cutting edge 41, a third cutting edge 42, a fourth cutting edge 43, and a fifth cutting edge 44. Each of the cutting edges extend from point 29 generally to the periphery of the end portion of the hook.

While points formed by three and five flat surfaces have been illustrated in FIGS. 1, 2 and 3, it will be readily understood that any number of flat surfaces can be chosen by those skilled in the art without departing from the intent of the present invention. However, it is essential that one of the flat surfaces be on the side of the end portion closest to the shank and lie in a plane which is generally transverse to a plane taken through the longitudinal axes of the shank and end portions.

Figure 4:
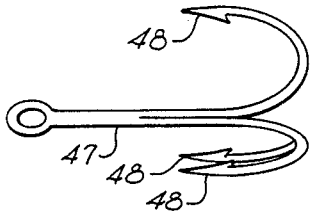
FIG. 4 is a view of a fishhook having multiple curved and barbed portions and end points sharpened in accordance with the invention.

FIG. 4 shows a multi-fishhook embodying the invention. Each of these fishhooks have shanks 47 and hooks 48 which correspond to the hooks as shown and described herein, as by way of example in FIGS. 1, 2 and 3.

It will be understood that the invention may be embodied in various types of lures and fishhooks without departing from the essence of the present invention.

Figure 5:
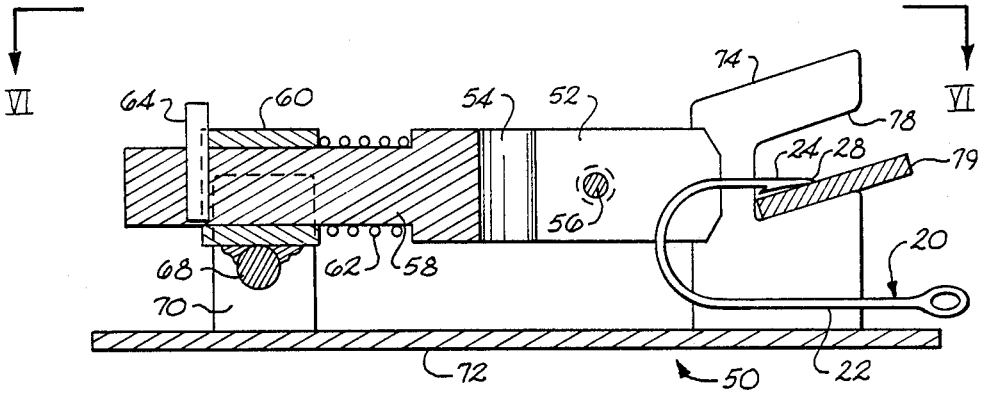
FIG. 5 is a side view of an apparatus for producing flat surfaces on the end portion of a fishhook in accordance with the invention that is taken generally along line 5—5 of FIG. 6.
Figure 6:
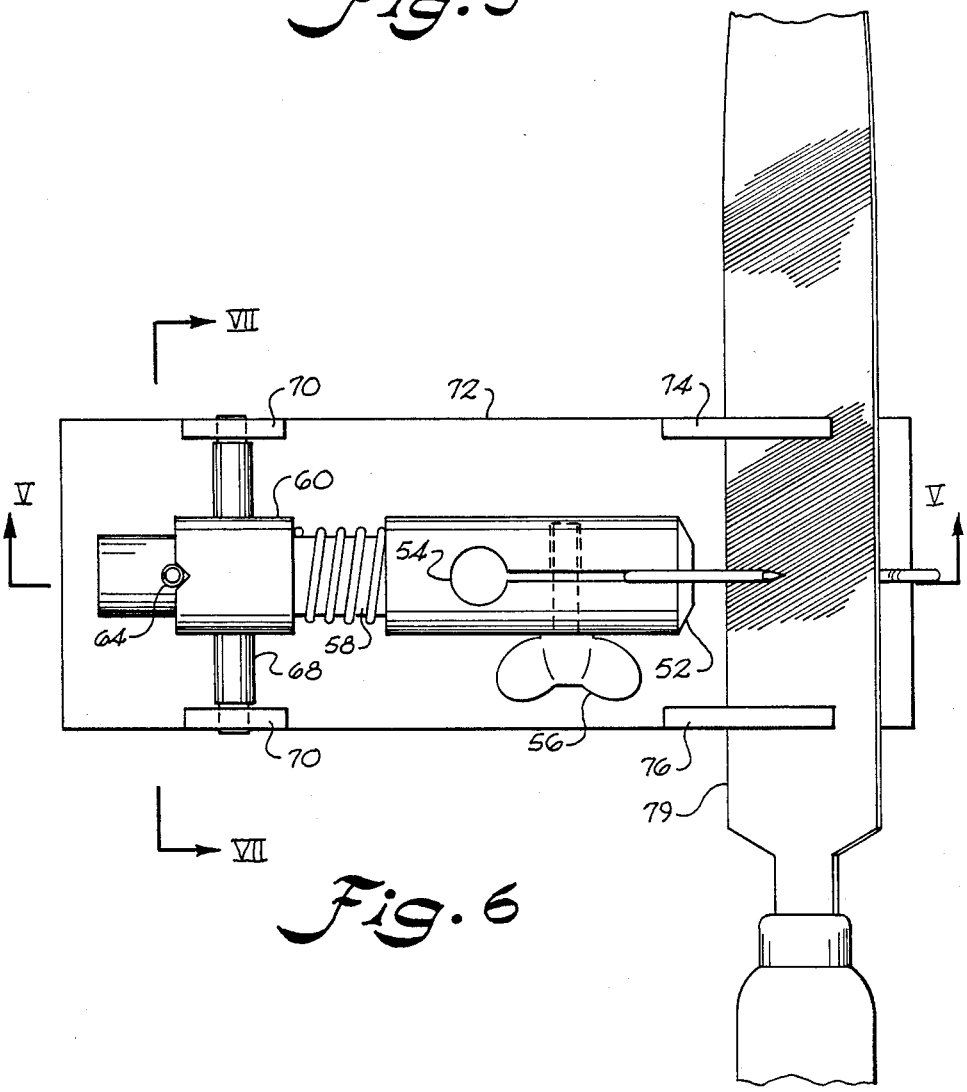
FIG. 6 is a plan view of the apparatus illustrated in FIG. 5, taken generally along lines 6—6 of FIG. 5.
Figure 7:
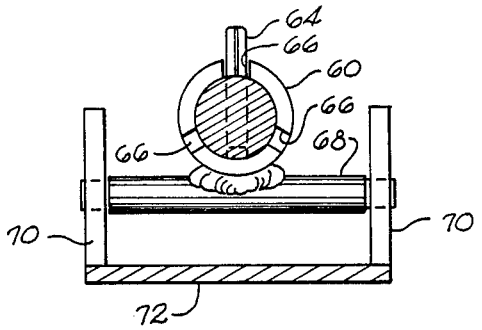
FIG. 7 is a rear end view of the apparatus of FIG. 6 taken generally along line 7—7 of FIG. 6.

Referring now to FIGS. 5, 6 and 7 of the drawings, in which a preferred embodiment of the invention is illustrated. Sharpening device 50 comprises a fishhook holding jaws 52 which are formed by cutting a slot in barstock and by drilling a relief opening 54 transverse of the longitudinal axis of the holding jaws. Holding jaws 52 have threaded transverse of the jaws a clamping screw or bolt 56 which pulls the jaws 52 together to hold the fishhook 20 in place.

Extending from the clamping jaws 52 is a reduced portion 58 which extends through a support sleeve 60. A resilient spring 62 urges the clamping jaws 52 away from sleeve member 60. Reduced portion 58 extends beyond sleeve 60 and includes a locking pin 64, which extends through a transverse opening in reduced portion 58 and retains the reduced portion within sleeve 60. Reduced portion 58 is free to rotate within sleeve 60 but is retained in an interlocking position with sleeve 60 by locking pin 64 fitting within locking notch 66, three or more of which are milled or machined into sleeve 60, as best seen in FIG. 7.

Sleeve 60 is supported by an axle 68 which is welded or braised onto the sleeve which, in turn, fits within recesses in axle lugs 70 which extend vertically from a horizontal base 72.

On the end of base 72, opposite to lugs 70, are two upright or vertically extending guide walls 74 and 76. Each of the guide walls 74 and 76 has a guide slot 78 for guiding a file, stone or other grinding implement which may be used for shaping the flat surfaces on the end portion of the fishhook. As best seen in FIG. 5, it will be noted that slot 78 is shaped so that the file will intersect with the longitudinal axis of clamp or holding jaws 52 and that the end portion of hook 20 generally extends along the longitudinal axis of holding jaws 52. With the hook and the file in the position shown in FIG. 5, all is in readiness for grinding or shaping surface 30 on the end portion of the fishhook. The engagement of locking pin 64 in locking notch 66 is such as to retain hook 20 in the desired plane for the shaping of flat surface 30. Once surface 30 has been shaped to the satisfaction of the user, locking pin 64 is moved in opposition to spring 62 to a second locking notch 66 which rotates the end portion of the hook so that the second flat surface 32 may be shaped by the user of the apparatus. Once surface 32 has been completed, the holding jaws are again rotated to a third locking notch whereby a third flat surface 34 may be shaped by the user of the apparatus thereby producing a fishhook in accordance with that shown in FIGS. 1 and 2.

Where it is desired to produce a fishhook having more than three flat surfaces at the end portion, it will only be necessary to provide additional locking notches 66 appropriately spaced about the periphery of the end of sleeve 60.

Figure 8:
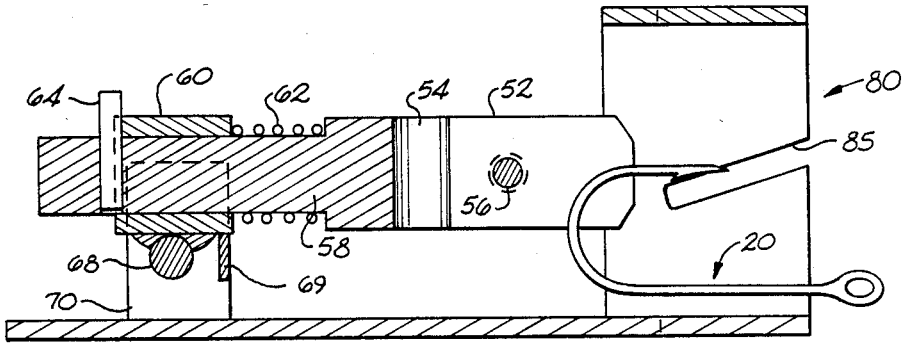
FIG. 8 is a side view, partially in section, similar to that of FIG. 5 illustrating a second embodiment of the apparatus of the invention.
Figure 9:
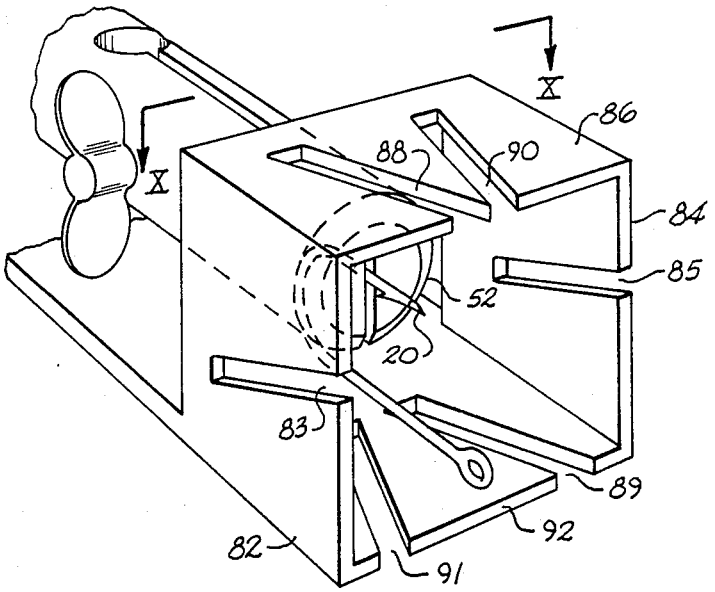
FIG. 9 is an end perspective view of the apparatus illustrated in FIG. 8 taken generally along line 9—9 of FIG. 8.

A second embodiment of the apparatus of the present invention is shown in FIGS. 8, 9, 10 and 11. Common parts of this apparatus with that shown in FIGS. 5, 6, and 7 have been identified with the same reference characters and such common parts will not be described in detail hereat. In this embodiment reduced portion 58 does not revolve within sleeve 60 and a plane taken through the axis of the shank and end portion of fishhook 20 will be in the vertical as shown in FIG. 8.

At the end of base 72 opposite axle lugs 70, a guide box 80 is provided which comprises a first vertical wall 82 having a first guide slot 83 and a second vertical wall 84 having a second guide slot 85. Guide slots 83 and 85 are for guiding the file or other grinding surface when forming shovel surface 30 on the end portion of the fishhook. It should also be noted in this embodiment that axle lugs 70 have extending therebetween a support bar 69 which limits the pivoting motion of hook holding jaws 52 about the axis of axle 68.

Figure 10:
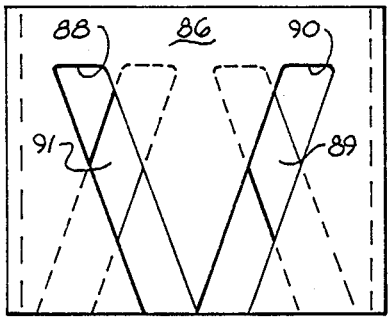
FIG. 10 is a top plan view of the guide box portion of the apparatus of FIG. 8 taken generally along line 10—10 of FIG. 9.
Figure 11:
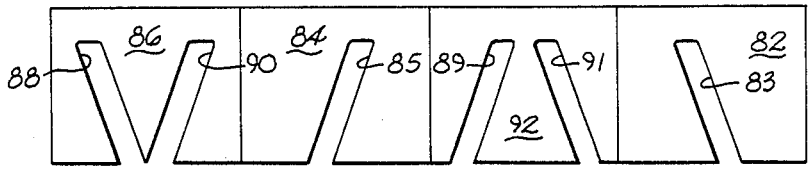
FIG. 11 is an opened up plan view of the guide box of FIG. 8.

Guide box 80 has a top wall 86 and a bottom wall 92. Top wall 86 (as best seen in FIGS. 10 and 11) is provided with a first top guide slot 88 and bottom wall 92 is provided with a first bottom guide slot 89. Guide slots 88 and 89 cooperate to guide the second flat surface 32 on the end portion of the fishhook. Top wall 86 has a second top guide slot 90 and bottom wall 92 has a second bottom guide slot 91 which cooperates with top guide slot 90 for guiding a file or other shaping instrument to produce flat surface 34 on the end portion of the fishhook.

In this embodiment it will be seen that all that is necessary is to clamp the fishhook in the holding jaws 52 as seen in FIG. 8, and to retain it in that position and to insert the grinding implement such as a file, into first guide slots 83 and 85 to produce flat surface 30 and thereafter into guide slots 88 and 89 to produce flat surface 32 and guide slots 90 and 91 to produce third flat surface 34.

Figure 13:
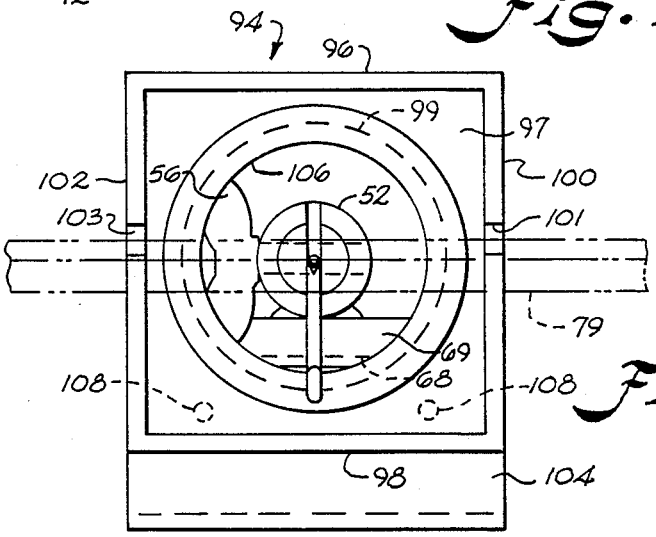
FIG. 13 is an end perspective view of the apparatus of FIG. 12 taken generally along line

Referring now to FIGS. 12 and 13, wherein a third embodiment of the invention is illustrated. In this embodiment, as in the second embodiment, common elements of all three embodiments are identified by the same reference characters and will not be described in detail herein since their function is the same in all three embodiments. However, it should be noted that in this embodiment as in the second embodiment, holding jaws 52 do not revolve within sleeve 60 and a plane taken through the shank and end portions of fishhook 20 will be maintained in the vertical. At the end of base 72, opposite axle lugs 70 there is provided a rotary guide box 94. Guide box 94 comprises a top wall 96, a back wall 97, and a bottom wall 98. Connecting top wall 96 and bottom wall 98 are two vertical guide walls 100 and 102. Walls 100 and 102 have, respectively, guide slots 101 and 103 for guiding the file or other shaping implement when shaping the surfaces of the fishhook.

Rotary guide box 94 is supported from base 72 by vertical guide box support 104. Back wall 97 has a circular opening 99 which fits within a generally C-shaped guide box support lip 106, which is formed in vertical guide box support 104. Thus, rotary guide box 94 may be rotated 360° about the longitudinal axis of the fishhook holding jaws 52 and the longitudinal axis of the end portion of the fishhook 20. Rotary guide box 94 is locked into one of several positions during the grinding or shaping of the flat surfaces on the fishhook by means of locking pins or detents 108, two or more of which are in a position to lock the rotary guide box in the position necessary to produce the desired flattened surfaces on fishhook 20.

The method of producing the flat surfaces on the end portions of fishhook 20 is the same regardless of which of the three embodiments of the apparatus is utilized. The fishhook is held with the end portion along the longitudinal axis of the holding jaws and the end portion is brought into contact with file 79 or some other appropriate guiding element. File 79 is moved manually, transverse of the longitudinal axis of the end portion, and shapes or grinds the flat surface onto the end portion of fishhook 20. In the embodiment of the invention shown in FIG. 5, fishhook 20 is revolved about the longitudinal axis of the end portion so as to present other peripheral areas of the end portion to the file for shaping in order to produce the flat surfaces of the fishhook of FIG. 2 or the fishhook of FIG. 3, depending on the number of flat surfaces desired In the embodiment of FIG. 8, fishhook 20 remains stationary in jaws 52 and file 79 is guided in various guide slots so as to produce the flat surfaces desired.

With regard to the embodiment of the apparatus in FIG. 12, rotary guide box 94 is rotated about the longitudinal axis of the end portion of fishhook 20 so as to present selected peripheral portions of the end portion to file 79 to produce the flat surfaces required by the fishhook of FIG. 2 or the fishhook of FIG. 3, or to produce any number of flat surfaces desired.

While the fishhook of the invention has an end portion, as illustrated, with three or five flat surfaces, it is to be understood that any desired number of surfaces can be used to shape the end portion into the point desired provided that one of the surfaces is generally transverse to a plane taken through the longitudinal axes of the end and shank portions. It should also be noted that the angle of the various faces may be varied. It is also to be understood that the method of shaping the end portion of the fishhook can readily be performed on either of the three embodiments of apparatus of the invention disclosed and illustrated herein and that various embodiments of the apparatus of the invention might be constructed in accordance with the essential guidelines disclosed herein without departing from the scope of the appended claims.

While three embodiments of the apparatus have been described using specific terms, such description is for illustrative purposes only, and it is to be understood that changes and variations may be made in such apparatus without departing from the spirit or scope of the following claims.

What is claimed is:

1. An apparatus for sharpening a fishhook which has a shank portion, a curved portion, a barbed portion, and an elongate end portion, comprising:

(a) rotary means for supporting said fishhook for revolution about the longitudinal axis of said end portion; so that a line tangent to said curved portion may lie in at least three different planes which intersect the longitudinal axis of said end portion;

(b) grinding means movable transversely of said end portion for grinding flat surfaces on said end portion; and (c) stationary means for guiding said grinding means in a fixed plane which intersects the longitudinal axis of said end portion, whereby said grinding means will grind flat surfaces on said end portion of said fishhook at least three circumferentially spaced positions with the plane of each of said flat surfaces intersecting the plane of at least two other flat surfaces and said longitudinal axis of said end portion.

2. An apparatus for sharpening a fishhook as set forth in claim 1, wherein the means for supporting said fishhook is locked against rotation in at least three positions for grinding circumferentially spaced flat surfaces on the end portion of said fishhook.

3. An apparatus for sharpening a fishhook which has a shank portion, a curved portion, a barbed portion, and an end portion, comprising:

(a) means for supporting said fishhook for rotation about the longitudinal axis of said end portion of said fishhook;

(b) grinding means movable transversely of said end portion for grinding a flat surface on said end portion in a predetermined plane which intersects the longitudinal axis of said end portion; and (c) means for locking said fishhook supporting means against rotation in at least three different predetermined positions whereby said grinding means will grind flat surfaces on the end portion of said fishhook at three circumferentially spaced positions with the plane of each of said flat surfaces intersecting the plane of at least two other flat surfaces.

4. An apparatus for sharpening a fishhook as set forth in claim 3, wherein said locking means are spaced 120° apart.

5. An apparatus for sharpening a fishhook as set forth in claim 3, wherein the means for locking said fishhook supporting means against rotation provides more than three positions for grinding more than three flat surfaces on the end portion of said fishhook.

6. An apparatus for sharpening a fishhook as set forth in claim 3, wherein the means for supporting said fishhook comprises clamping jaws for clamping said fishhook.

7. An apparatus for sharpening a fishhook as set forth in claim 3, wherein said transversely movable means comprises a grinding surface and a handle for manually moving said transverse movable means for grinding the flat surface onto said fishhook end portion.

8. An apparatus for sharpening a fishhook which has a shank portion, a curved portion, a barbed portion, and an elongate end portion, comprising:

(a) stationary means for supporting said fishhook with the longitudinal axis of said end portion disposed within a fixed plane;

(b) grinding means movable substantially perpendicular to the longitudinal axis of said end portion for grinding flat surfaces on said end portion; and (c) guide means disposed to revolve around the longitudinal axis of said end portion for guiding said grinding means in at least three planes which are circumferentially spaced about the longitudinal axis of said end portion, each of which planes intersect the longitudinal axis of said end portion, whereby said grinding means will grind flat surfaces on said end portion of said fishhook at three circumferentially spaced positions with the plane of each of said flat surfaces intersecting the plane of at least two other flat surfaces and said longitudinal axis.

9. An apparatus for sharpening a fishhook as in claim 8, wherein means are provided for locking the guide means against rotation about the longitudinal axis of the end portion in three circumferentially spaced positions.

10. An apparatus for producing a sharp fishhook which has a shank portion, a curved portion, a barbed portion, and an elongate end portion, comprising:

(a) means for supporting said fishhook with the longitudinal axis of said end portion disposed within a fixed plane;

(b) means for shaping a first flat surface on the side of said end portion closest to said shank, which flat surface lies in a plane which is generally transverse to a plane drawn through the longitudinal axes of said shank portion and said end portion, and which also intersects the longitudinal axis of said end portion and said fixed plane in which the longitudinal axis of said end portion is disposed;

(c) means for shaping a second flat surface at said end portion which lies in a plane which intersects the plane of said first flat surface, the longitudinal axis of said end portion, and the fixed plane in which said longitudinal axis of said end portion is disposed;

(d) means for shaping a third flat surface at said end portion which lies in a plane which intersects the plane of said first flat surface, the longitudinal axis of said end portion, and the fixed plane in which said longitudinal axis of said end portion is disposed; and (e) guide means located about said end portion of said fishhook, said guide means defining a plurality of pairs of slots therein, each pair of said slots being provided for guiding said shaping means for forming one of said flat surfaces at said end portion of said fishhook.

11. An apparatus for producing a sharp fishhook as set forth in claim 10, wherein the plane of said third flat surface intersects the planes of said first and second flat surfaces and also intersects the longitudinal axis of said end portion.

12. An apparatus for producing a sharp fishhook as set forth in claim 10, wherein means are provided for producing more than three flat surfaces o said end portion of said hook, each of which lies in a plane which intersects the longitudinal axis of said end portion and the planes of two adjacent flat surfaces.

* * * * *